US012369762B1

(12) United States Patent
Persaud

(10) Patent No.: US 12,369,762 B1
(45) Date of Patent: Jul. 29, 2025

(54) BATHROOM SANITATION ARRANGEMENT

(71) Applicant: Mootie Persaud, Shirly, NY (US)

(72) Inventor: Mootie Persaud, Shirly, NY (US)

( * ) Notice: Subject to any disclaimer, the term of this patent is extended or adjusted under 35 U.S.C. 154(b) by 18 days.

(21) Appl. No.: 18/414,906

(22) Filed: Jan. 17, 2024

(51) Int. Cl.
*A47K 17/00* (2006.01)

(52) U.S. Cl.
CPC ..... *A47K 17/00* (2013.01)

(58) Field of Classification Search
CPC ..... A47K 17/00
USPC ..... 206/223, 581
See application file for complete search history.

(56) References Cited

U.S. PATENT DOCUMENTS 3,429,474 A 2/1969 Cann
4,008,933 A 2/1977 Wanek
5,971,141 A * 10/1999 Shafik ..... A47K 11/10 206/823
5,984,100 A * 11/1999 Ramsey ..... A47K 17/00 206/581
6,109,429 A * 8/2000 Cunningham ..... A47K 17/00 206/823
D525,467 S 7/2006 Michelson
8,827,077 B1 * 9/2014 Cummins ..... A45C 11/24 206/581
9,104,369 B1 8/2015 Allen
2002/0027402 A1 3/2002 Hanser
2008/0029415 A1 2/2008 Wang
2008/0197030 A1 * 8/2008 Wang ..... B65F 1/1607 206/216
2009/0260998 A1 * 10/2009 Davidson ..... A47K 17/00 206/207
2014/0216957 A1 8/2014 Orozco
2016/0000281 A1 * 1/2016 Butts ..... A47G 29/08 206/349
2022/0307250 A1 9/2022 Buckley

FOREIGN PATENT DOCUMENTS

CA 2587123 10/2008

* cited by examiner

*Primary Examiner* — Jacob K Ackun

(57) ABSTRACT

A bathroom sanitation arrangement for organizing bathroom maintenance devices includes a first compartment, a second compartment, and a third compartment. The third compartment is disposed under the first compartment. The first compartment is disposed next to the second compartment. The first compartment is designed to house a toilet brush and a toilet plunger. The second compartment is designed to house a trash receptacle. The third compartment is designed to house a drip tray. The first compartment and the third compartment are divided by a wall. The wall comprises at least one aperture therein designed to permit passage of liquids from the first compartment to the third compartment.

17 Claims, 8 Drawing Sheets

BATHROOM SANITATION ARRANGEMENT

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to devices for organizing cleaning and sanitary tools in bathrooms and more particularly pertains to a new device for organizing cleaning and sanitary tools in bathrooms. Organizing devices are useful for keeping bathroom cleaning tools, such as toilet brushes and plungers, near the toilets, for the convenience of those cleaning or maintaining the toilets. It is important for such devices to be relatively sanitary and promote a clean aesthetic, especially in public bathrooms with heavy usage and repeated cleaning routines.

(2) Description of Related Art Including Information Disclosed Under 37 CFR 1.97 and 1.98

The prior art relates to devices for organizing cleaning and sanitary tools in bathrooms. The prior art does not disclose a bathroom organizer that includes multiple compartments for housing a trash receptacle, a removeable drip tray, and a toilet brush and a toilet plunger.

BRIEF SUMMARY OF THE INVENTION

An embodiment of the disclosure meets the needs presented above by generally comprising a bathroom sanitation arrangement for organizing bathroom maintenance devices that includes a first compartment, a second compartment, and a third compartment. The third compartment is disposed under the first compartment. The first compartment is disposed next to the second compartment. The first compartment is designed to house a toilet brush and a toilet plunger. The second compartment is designed to house a trash receptacle. The third compartment is designed to house a drip tray. The first compartment and the third compartment are divided by a wall. The wall comprises at least one aperture therein designed to permit passage of liquids from the first compartment to the third compartment. In this manner, a single structure can conveniently house a trash receptacle and bathroom cleaning tools, such as a toilet brush and toilet plunger. The at least one aperture in the wall allows liquids to drip into the drip tray below, thereby maintaining the first compartment in a relatively dry and sanitary condition by minimizing the accumulation of liquids and the corresponding growth of bacteria and fungus or mold. The drip tray keeps the liquids in a separate area that can be relatively easily cleaned by a user to further promote sanitary conditions. The single container also presents a relatively pleasant aesthetic by housing the trash receptacle and the cleaning tools in a relatively concealed manner. Such a design could be useful in all types of bathrooms, and especially public restrooms for the convenience of sanitation or maintenance workers who must frequently clean the restrooms.

It should be understood that the bathroom sanitation arrangement may simply consist of the compartments and the drip tray without the trash receptacle, toilet plunger, and toilet brush. However, in accordance with at least one possible embodiment, the bathroom sanitation arrangement is a kit that also includes the trash receptacle and/or the toilet plunger and/or the toilet brush.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
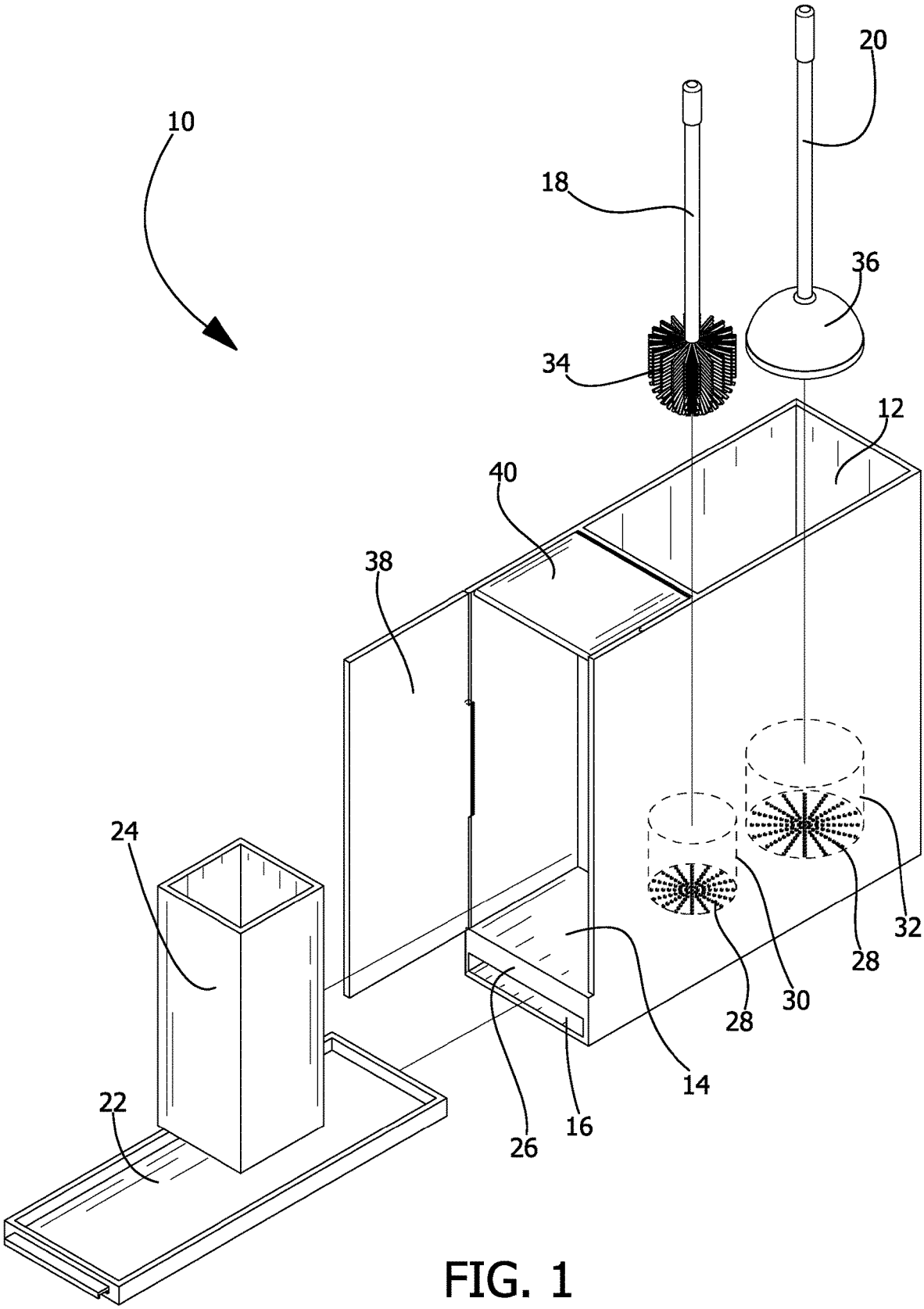
FIG. 1 is a perspective view of a bathroom sanitation arrangement according to an embodiment of the disclosure.
Figure 2:
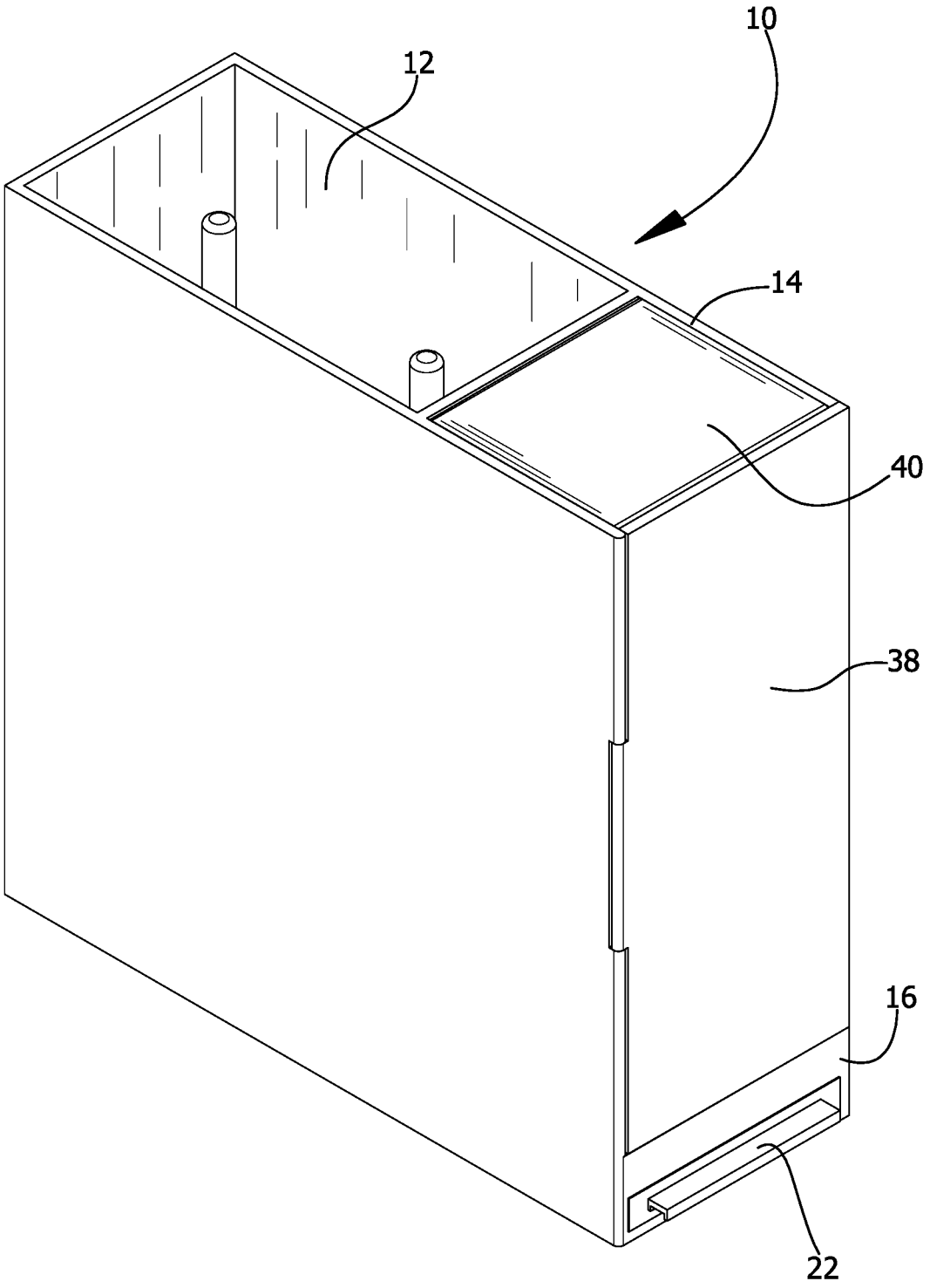
FIG. 2 is a perspective view of the bathroom sanitation arrangement.
Figure 3:
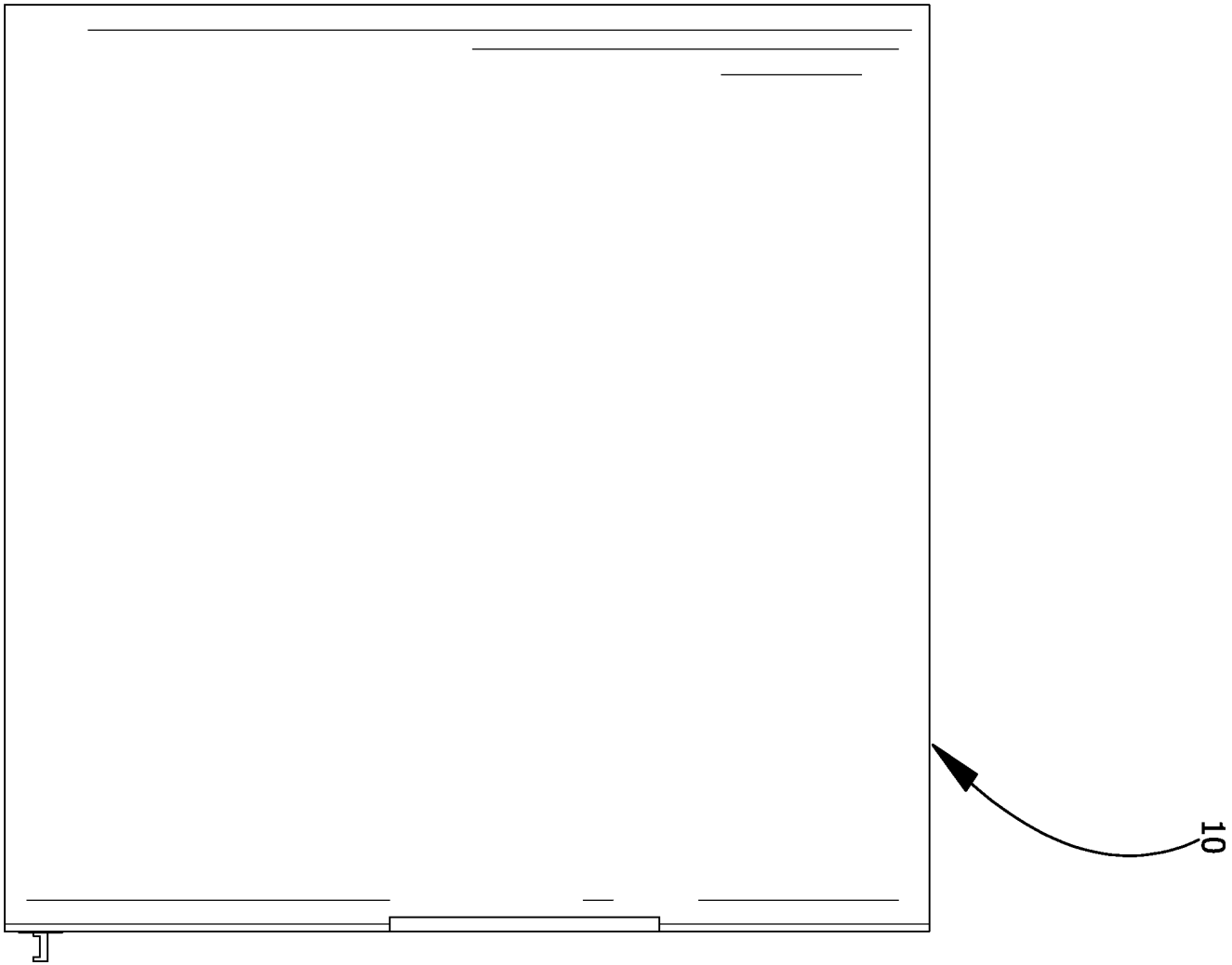
FIG. 3 is a side view of the bathroom sanitation arrangement.
Figure 4:
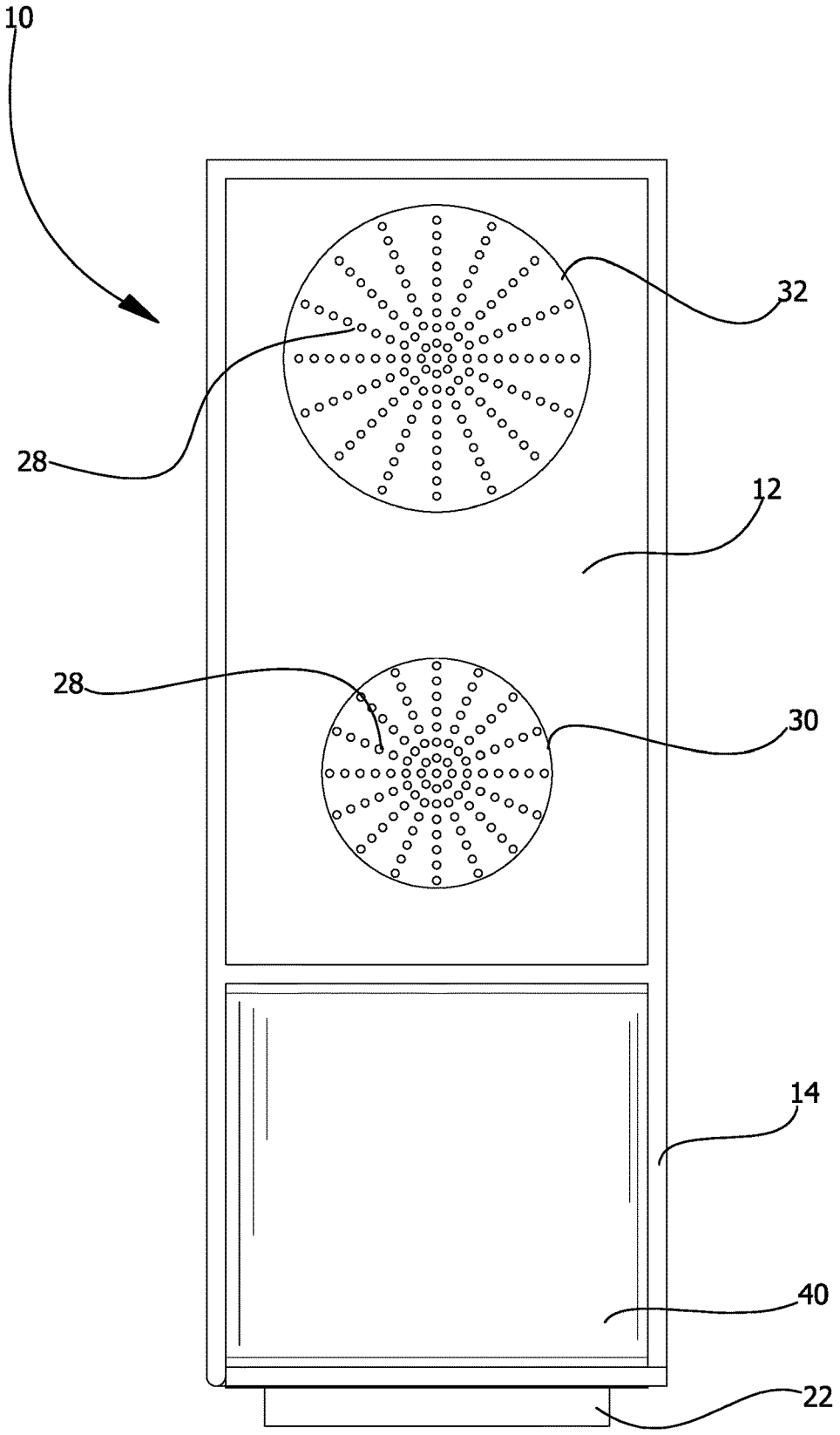
FIG. 4 is a top view of the bathroom sanitation arrangement.
Figure 5:
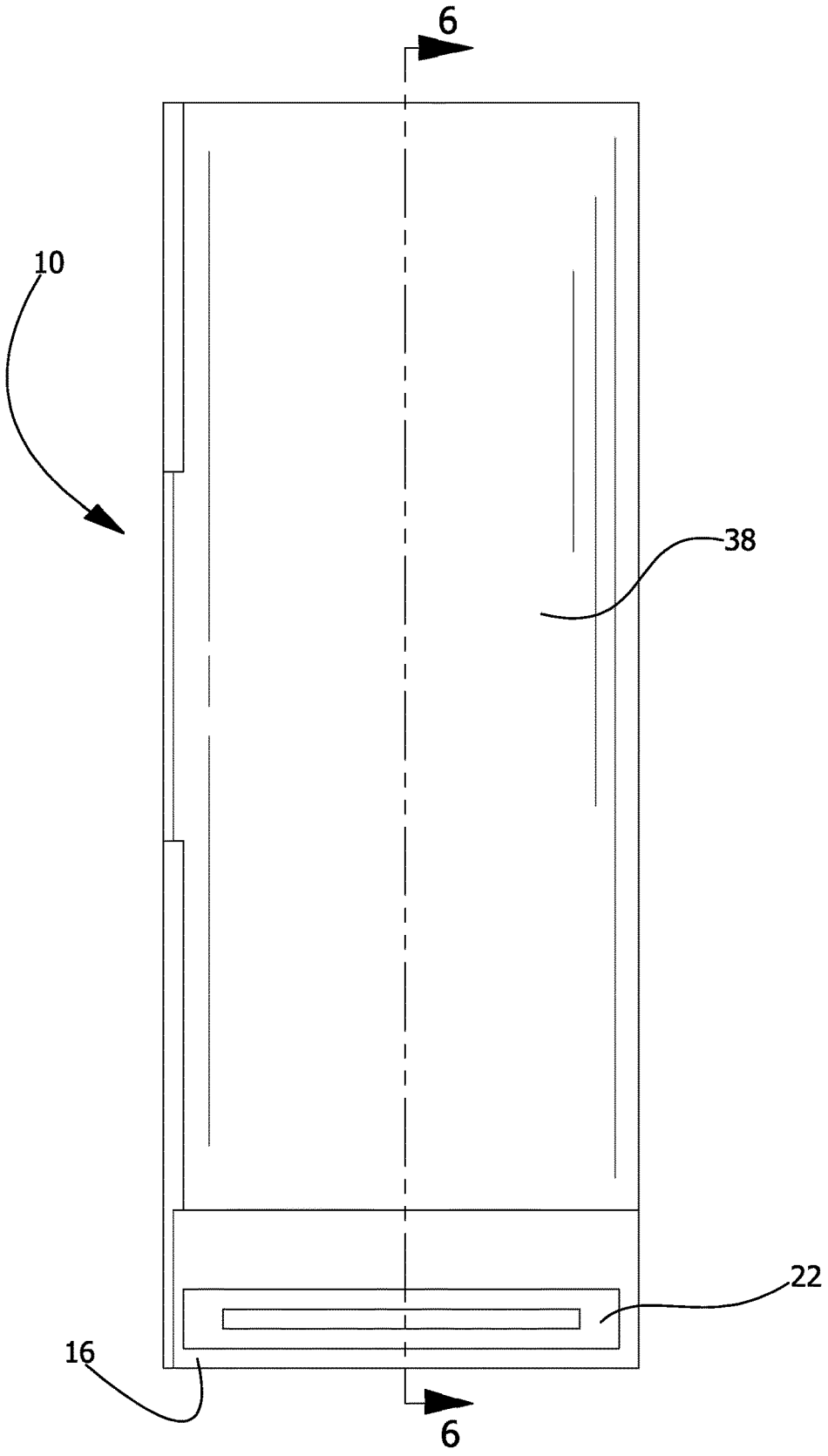
FIG. 5 is a side view of the bathroom sanitation arrangement.
Figure 6:
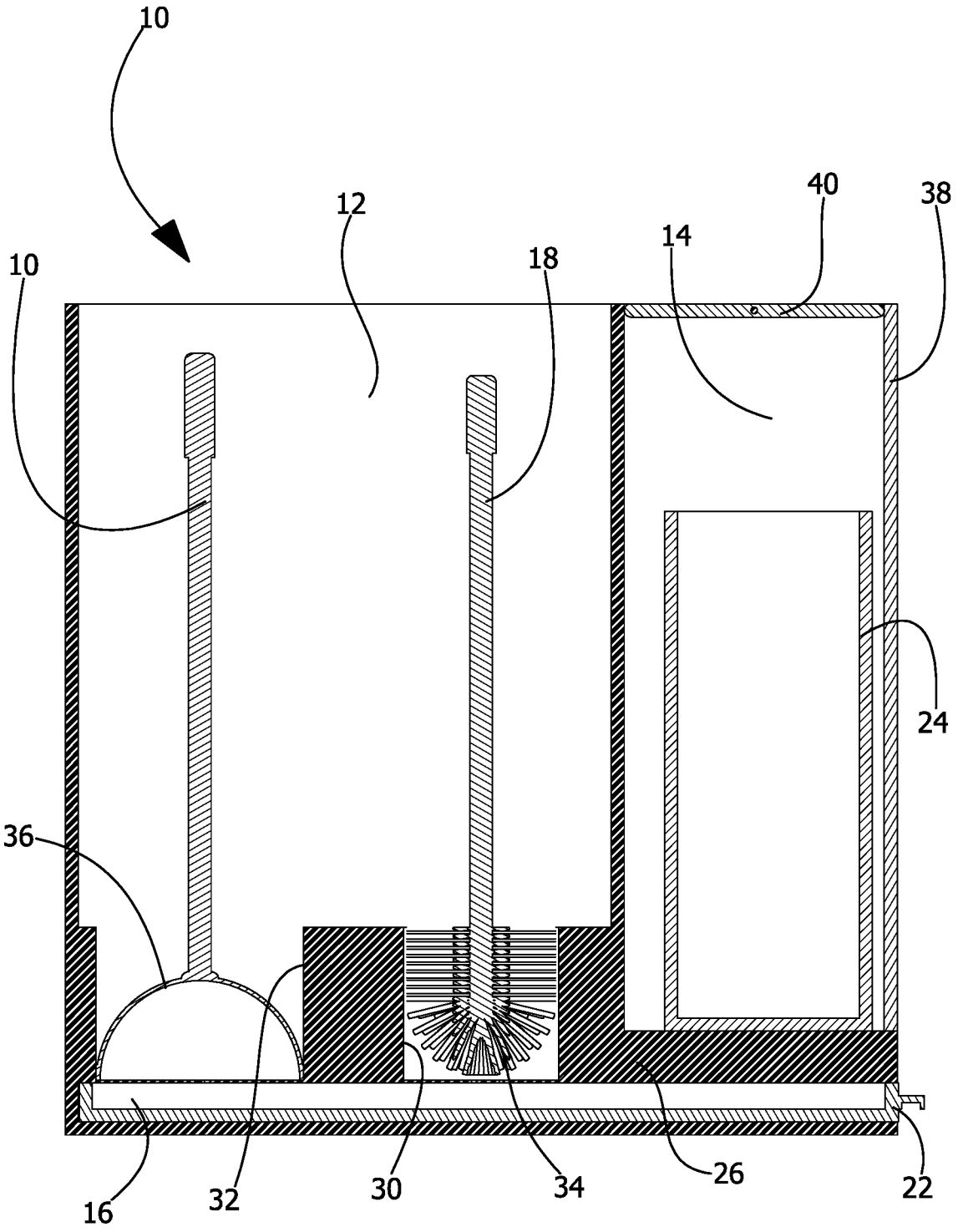
FIG. 6 is a cross-sectional view of the bathroom sanitation arrangement.

With reference now to the drawings, and in particular to FIGS. 1 through 8 thereof, a new bathroom sanitation arrangement for organizing cleaning and sanitary tools in bathrooms embodying the principles and concepts of an embodiment of the disclosure and generally designated by the reference numeral 10 will be described.

As best illustrated in FIGS. 1 through 8, the bathroom sanitation arrangement 10 generally comprises a first compartment 12, a second compartment 14, and a third compartment 16. The third compartment 16 is positioned under the first compartment 12. The first compartment 12 is positioned next to the second compartment 14. The first compartment 12 is designed to house a toilet brush 18 and a toilet plunger 20. The second compartment 14 is designed to house a trash receptacle 24, such as a trash can or bin. The third compartment 16 is designed to house a drip tray 22. The first compartment 12 and the third compartment 16 are divided by a wall 26. The wall 26 includes at least one aperture 28 therein designed to permit passage of liquids, such as water or cleaning fluid dripping from a toilet brush 18 or a toilet plunger 20 after use thereof, from the first compartment 12 to the third compartment 16. The drip tray 22 is positioned in the third compartment 16 and below the at least one aperture 28 to collect the liquids dripping therethrough. The third compartment 16 is open on one side to permit insertion and removal of the drip tray 22 into and out of the third compartment 16. The third compartment 16 extends under both the first compartment 12 and the second compartment 14. The wall 26 forms the bottom of the first compartment 12 and the second compartment 14 and the top of the third compartment 16.

The first compartment 12 includes a brush receptacle 30 designed to receive and store a brush head 34 of the toilet brush 18. The first compartment 12 also includes a plunger receptacle 32 configured to receive and store a plunger cup 36 of the toilet plunger 20. The second compartment 14 is open on top to permit insertion and removal of the toilet brush 18 and the toilet plunger 20 into and out of the first compartment 12. In the embodiment shown in FIG. 1, there is a first set of apertures 28 positioned in the bottom of the brush receptacle 30, and there is a second set apertures 28 positioned in the bottom of the plunger receptacle 32.

The second compartment 14 includes an openable and closable door 38 on one side to permit insertion and removal of the trash receptacle 24. In addition, the second compartment 14 includes a cover 40 positioned in a top portion of the second compartment 14. The cover 40 is pivotable to permit trash to be inserted past the cover 40 and into the trash receptacle 24 below the cover 40.

In accordance with at least one possible embodiment, the first compartment 12 is sufficiently tall to contain the entirety of a toilet brush 18 and a toilet plunger 20 is oriented vertically in the first compartment 12. The first compartment 12 is substantially rectangular and approximately twice the size of the second compartment 14. Each of the brush receptacle 30 and the plunger receptacle 32 includes a cylindrical receptacle integrally formed into the first compartment 12.

In accordance with at least one possible embodiment, the bathroom sanitation arrangement 10 is a kit that includes the trash receptacle 24 and/or the toilet brush 18 and/or the toilet plunger 20.

Figure 7:
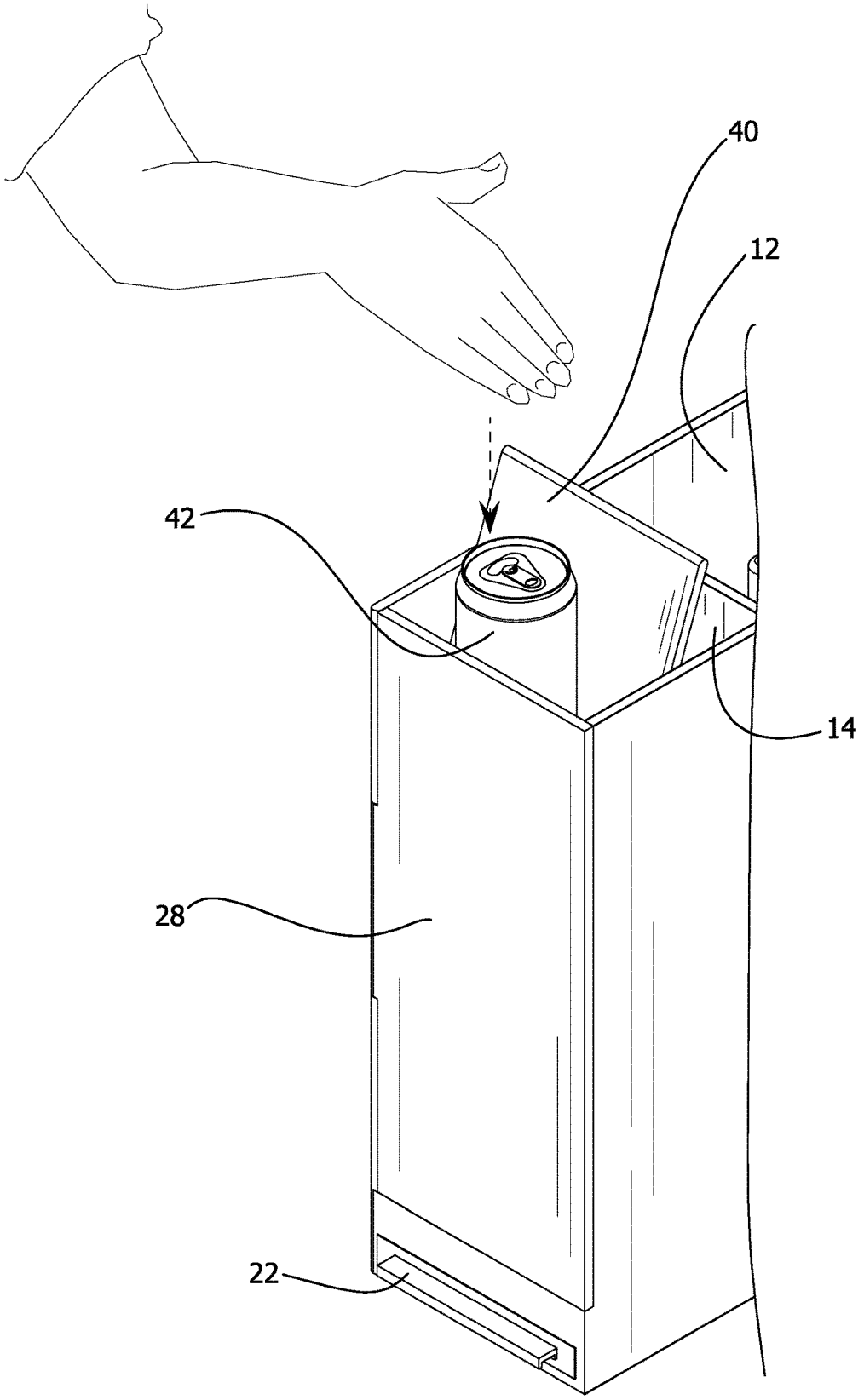
FIG. 7 is a perspective view of the trash portion of the bathroom sanitation arrangement.
Figure 8:
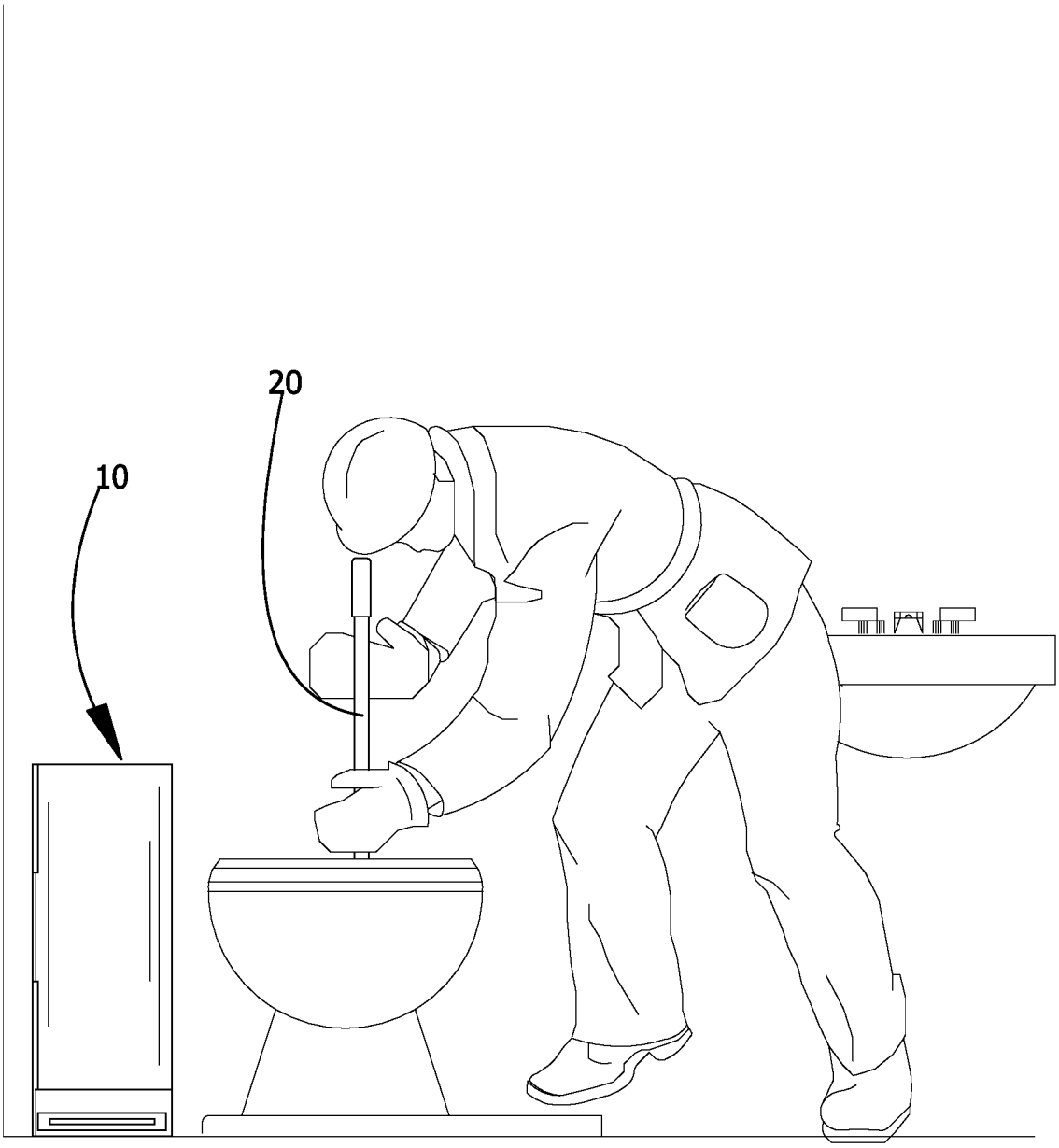
FIG. 8 is a front view of the bathroom sanitation arrangement in use.

In use, a user can place the toilet brush 18 and the toilet plunger 20 in the corresponding brush receptacle 30 and plunger receptacle 32, such as after using those tools. Since those tools will likely be covered in cleaning fluids or toilet water, those liquids can pass through the wall 26 via the apertures 28. The liquids will be caught in the drip tray 22, which can subsequently be removed to dump out the liquids. Trash 42 can be thrown away by the user in the trash receptacle 24 via the pivotable cover 40, as shown in FIG. 7.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bathroom sanitation arrangement for organizing bathroom maintenance devices comprising:

a first compartment, a second compartment, and a third compartment;

said third compartment being disposed under said first compartment;

said first compartment being disposed next to said second compartment;

said first compartment being configured to house a toilet brush and a toilet plunger;

said second compartment being configured to house a trash receptacle;

said third compartment being configured to house a drip tray;

said first compartment and said third compartment being divided by a wall;

said wall comprising at least one aperture therein configured to permit passage of liquids from said first compartment to said third compartment;

wherein said first compartment comprises a brush receptacle configured to receive and store a brush head of a toilet brush;

wherein said first compartment comprises a plunger receptacle configured to receive and store a plunger cup of a toilet plunger; and wherein said second compartment being open on top to permit insertion and removal of a toilet brush and a toilet plunger into and out of said first compartment.

2. The bathroom sanitation arrangement according to claim 1, wherein:

said at least one aperture in said wall comprises a first set of apertures disposed in the bottom of said brush receptacle; and said at least one aperture in said wall comprises a second set of apertures disposed in the bottom of said plunger receptacle.

3. The bathroom sanitation arrangement according to claim 1, wherein each of said brush receptacle and said plunger receptacle comprises a cylindrical receptacle integrally formed into said first compartment.

4. The bathroom sanitation arrangement according to claim 1, wherein:

said bathroom sanitation arrangement further comprises a trash receptacle disposed in said second compartment; and said second compartment comprises an openable and closable door on one side to permit insertion and removal of said trash receptacle.

5. The bathroom sanitation arrangement according to claim 1, wherein said first compartment is substantially rectangular and approximately twice the size of said second compartment.

6. The bathroom sanitation arrangement according to claim 1, wherein said sanitation arrangement further comprises a toilet brush and a toilet plunger.

7. A bathroom sanitation arrangement for organizing bathroom maintenance devices comprising:

a first compartment, a second compartment, and a third compartment;

said third compartment being disposed under said first compartment;

said first compartment being disposed next to said second compartment;

said first compartment being configured to house a toilet brush and a toilet plunger;

said second compartment being configured to house a trash receptacle;

said third compartment being configured to house a drip tray;

said first compartment and said third compartment being divided by a wall;

said wall comprising at least one aperture therein configured to permit passage of liquids from said first compartment to said third compartment;

wherein said bathroom sanitation arrangement further comprises a drip tray disposed in said third compartment and below said at least one aperture to collect liquids dripping therethrough; and wherein said third compartment being open on one side to permit insertion and removal of said drip tray into and out of said third compartment.

8. The bathroom sanitation arrangement according to claim 7, wherein:

said first compartment comprises a brush receptacle configured to receive and store a brush head of a toilet brush;

said first compartment comprises a plunger receptacle configured to receive and store a plunger cup of a toilet plunger; and said second compartment being open on top to permit insertion and removal of a toilet brush and a toilet plunger into and out of said first compartment.

9. The bathroom sanitation arrangement according to claim 8, wherein:

said at least one aperture in said wall comprises a first set of apertures disposed in the bottom of said brush receptacle; and said at least one aperture in said wall comprises a second set of apertures disposed in the bottom of said plunger receptacle.

10. The bathroom sanitation arrangement according to claim 9, wherein:

said bathroom sanitation arrangement further comprises a trash receptacle disposed in said second compartment; and said second compartment comprises an openable and closable door on one side to permit insertion and removal of said trash receptacle.

11. The bathroom sanitation arrangement according to claim 10, wherein:

said second compartment comprises a cover disposed in a top portion of said second compartment; and said cover is pivotable to permit trash to be inserted past said cover and into said trash receptacle below said cover.

12. The bathroom sanitation arrangement according to claim 11, wherein said first compartment is sufficiently tall to contain the entirety of a toilet brush and a toilet plunger being oriented vertically in said first compartment.

13. The bathroom sanitation arrangement according to claim 12, wherein said first compartment is substantially rectangular and approximately twice the size of said second compartment.

14. The bathroom sanitation arrangement according to claim 13, wherein said third compartment extends under both said first compartment and said second compartment; and said wall forms the bottom of said first compartment and said second compartment and the top of said third compartment.

15. The bathroom sanitation arrangement according to claim 14, wherein each of said brush receptacle and said plunger receptacle comprises a cylindrical receptacle integrally formed into said first compartment.

16. The bathroom sanitation arrangement according to claim 15, wherein said sanitation arrangement further comprises a toilet brush and a toilet plunger.

17. A bathroom sanitation arrangement for organizing bathroom maintenance devices comprising:

a first compartment, a second compartment, and a third compartment;

said third compartment being disposed under said first compartment;

said first compartment being disposed next to said second compartment;

said first compartment being configured to house a toilet brush and a toilet plunger;

said second compartment being configured to house a trash receptacle;

said third compartment being configured to house a drip tray;

said first compartment and said third compartment being divided by a wall;

said wall comprising at least one aperture therein configured to permit passage of liquids from said first compartment to said third compartment wherein said third compartment extends under both said first compartment and said second compartment; and wherein said wall forms the bottom of said first compartment and said second compartment and the top of said third compartment.

* * * * *